United States Patent [19]

Van Blaircum et al.

[11] Patent Number: 5,004,069

[45] Date of Patent: Apr. 2, 1991

[54] STAMP FORMED MUFFLER WITH TRANSVERSE BAFFLE TUBE

[75] Inventors: Bennie A. Van Blaircum, Whitehouse; Jon W. Harwood, Toledo; Mark S. Kimmet, Ottoville, all of Ohio

[73] Assignee: AP Parts Manufacturing Company, Toledo, Ohio

[21] Appl. No.: 471,288

[22] Filed: Jan. 26, 1990

[51] Int. Cl.[5] ..... F01N 1/02; F01N 7/18

[52] U.S. Cl. ..... 181/282; 181/228; 181/243; 181/272; 181/273

[58] Field of Search ..... 181/212, 228, 230, 240, 181/243, 250, 255, 268, 272, 273, 282

[56] References Cited

U.S. PATENT DOCUMENTS

| | | | |
|---|---|---|---|
| 705,357 | 7/1902 | Keating . | |
| 1,110,040 | 9/1914 | Chatain . | |
| 2,484,826 | 10/1949 | Harley . | |
| 2,484,827 | 10/1949 | Harley . | |
| 2,658,580 | 11/1953 | Trembley . | |
| 2,860,722 | 11/1958 | Gerstung . | |
| 2,902,109 | 9/1959 | Burgess et al. . | |
| 2,943,695 | 7/1960 | Jeffords | 181/243 |
| 3,125,182 | 3/1964 | Earley . | |
| 3,140,755 | 7/1964 | Tranel | 181/282 |
| 3,158,222 | 11/1964 | Richmond | 181/273 |
| 3,176,791 | 4/1965 | Betts et al. | 181/260 |
| 3,198,284 | 8/1965 | Powers . | |
| 3,220,508 | 11/1965 | Norquest et al. . | |
| 3,412,825 | 11/1968 | Hall . | |
| 3,638,756 | 2/1972 | Thiele | 181/245 |
| 3,650,354 | 3/1972 | Gordon . | |
| 3,709,320 | 1/1973 | Höllerl et al. . | |
| 3,827,529 | 8/1974 | Frietzsche et al. . | |
| 3,852,041 | 12/1974 | Moore et al. . | |
| 4,108,274 | 8/1978 | Snyder | 181/229 |
| 4,109,751 | 8/1978 | Kabele | 181/247 |
| 4,132,286 | 1/1979 | Hasui et al. | 181/265 |
| 4,165,798 | 8/1979 | Martinez | 181/268 |
| 4,396,090 | 8/1983 | Wolfhugel | 181/282 |
| 4,415,059 | 11/1983 | Hayashi | 181/250 |
| 4,418,790 | 12/1983 | Agnew | 181/268 |
| 4,422,519 | 12/1983 | Nomura et al. | 181/228 X |
| 4,456,091 | 6/1984 | Blanchot | 181/282 |
| 4,523/660 | 6/1985 | Gaddi | 180/228 |
| 4,700,806 | 10/1987 | Harwood | 181/282 |
| 4,736,817 | 4/1988 | Harwood | 181/282 |
| 4,759,423 | 7/1988 | Harwood et al. | 181/282 |
| 4,760,894 | 8/1988 | Harwood et al. | 181/282 |
| 4,765,437 | 8/1988 | Harwood et al. | 181/282 |
| 4,821,840 | 4/1989 | Harwood et al. | 181/282 |
| 4,836,330 | 6/1989 | Harwood et al. | 181/282 |
| 4,847,965 | 7/1989 | Harwood et al. | 29/187 R |
| 4,860,853 | 8/1989 | Moring, III | 181/282 |

FOREIGN PATENT DOCUMENTS

| | | |
|---|---|---|
| 59-155528 | 9/1984 | Japan . |
| 59-43456 | 12/1984 | Japan . |
| 60-111011 | 6/1985 | Japan . |
| 61-14565 | 5/1986 | Japan . |
| 61-108821 | 5/1986 | Japan . |
| 61-155625 | 7/1986 | Japan . |
| 632013 | 1/1950 | United Kingdom . |
| 1012463 | 12/1965 | United Kingdom . |
| 2120318 | 11/1983 | United Kingdom . |

*Primary Examiner*—Benjamin R. Fuller

*Attorney, Agent, or Firm*—Anthony J. Casella; Gerald E. Hespos

[57] ABSTRACT

A muffler is provided with a pair of plates formed to define an array of tubes therebetween. At least one external shell is secured to at least one of the plates to surround selected portions of the tubes. The shell is formed to define a plurality of chambers separated from one another by a baffle crease. The baffle crease is parallel to and abutting a selected tube of the muffler to simplify the draw of metal material in the vicinity of the baffle crease and to thereby save metal. The baffle crease is of substantially uniform depth along a major portion of its length and is free of pockets that could conceivably retain corrosive fluids.

17 Claims, 3 Drawing Sheets

STAMP FORMED MUFFLER WITH TRANSVERSE BAFFLE TUBE

BACKGROUND OF THE INVENTION

Conventional prior art exhaust mufflers are elongated of oval or circular cross-section. These prior art mufflers include a plurality of cylindrical tubes supported in a parallel array by transverse baffles. The baffles typically define an oval or circular shape corresponding to the cross-sectional configuration of the muffler. The tubes and the supporting baffles are disposed within a tubular outer shell which closely engages the baffles, and therefore assumes and defines the oval or circular cross-sectional shape of the muffler. End caps or headers are connected to opposed ends of the tubular outer shell, and short tubular inlet and outlet nipples may be connected to the headers to define the inlet and outlet of the muffler.

The above described prior art muffler construction defines chambers intermediate the baffles and the outer shell of the muffler. Selected portions of the tubes passing through these chambers are perforated, louvered or are provided with other communication means to permit a controlled communication of exhaust gases from the tubes to the chambers of the muffler. Some chambers having perforated tubes passing therethrough are intended to permit the expansion of exhaust gases and/or cross-flow of exhaust gases from one perforated tube to another. Other chambers are provided merely to permit a return flow or change of direction of exhaust gases from one parallel tube to another. Still other chambers are closed end chambers into which a turning tube extends. These closed end chambers are low frequency resonating chambers which cooperate with the respective tuning tubes to attenuate a narrow range of low frequency noise. The dimensions of the tubes, perforations and chambers of the prior art muffler are selected in view of the exhaust gas flow characteristics and to achieve a specified attenuation of the noise associated with the flow of exhaust gas.

The above described conventional prior art mufflers generally perform well. However, they require a large number of separately manufactured components which typically must be assembled in a labor intensive manufacturing process. Mufflers of this type often are excessively heavy in view of the large number of separate components. Additionally, conventional prior art mufflers are relatively limited with respect to the possible sizes and shapes they may assume. Furthermore, designers of exhaust systems are relatively limited with respect to the possible locations for the inlet and outlet nipples and the corresponding alignments for the tail pipe and exhaust pipe leading to or from the conventional prior art muffler. These limitations with respect to the size and shape of the conventional prior art muffler and the alignment of exhaust pipes and tail pipes have become particularly significant in recent years in view of design constraints imposed on the engineers of exhaust systems. In particular, the exhaust system must compete with other vehicular components for the limited available space on the underside of the vehicle.

Mufflers comprising stamp formed components have been available for many years. Stamp formed mufflers have offered the potential for reducing the number of components required for the muffler and have further presented the potential for more automated manufacturing processes. Until recently, most prior art stamp formed mufflers consisted of expansion chambers where perforated tubes passed through a stamp formed chamber of the muffler. Mufflers of this type are functionally limited and generally cannot adequately attenuate all objectionable noise associated with the flow of exhaust gases. Examples of mufflers of this general type are shown in British Patent No. 632,013 which issued to White in 1949; British Patent No. 1,012,463 which issued to Woolgar on Dec. 8, 1965; Japanese Published patent Application No. 59-43456 which was published in 1984; and U.S. Pat. No. 4,132,286 which issued to Hasui et al. on Jan. 2, 1979. U.S. Pat. No. 4,415,059 which issued to Hayashi on Nov. 15, 1983 is a variation of these prior art stamp formed mufflers and shows a straight-through muffler with two short punch formed tuning tubes extending transverse to the through tube. The muffler shown in U.S. Pat. No. 4,415,059 would be functionally very limited, particularly for low frequency noise.

Other prior art stamp formed mufflers have merely included a circuitous array of nonperforated tubes and chambers through which the exhaust gases flow. Prior art stamp mufflers of this general type are shown in U.S. Pat. No. 3,176,791 which issued to Betts et al. on Apr. 6, 1965 and U.S. Pat. No. 3,638,756 which issued to Thiele on Feb. 1, 1972.

Still other prior art stamp formed mufflers include conventional tubular components disposed within a stamped outer shell. Examples of prior art of this type are shown in UK Patent Application No. 21 120 318 and U.S. Pat. No. 4,109,751 which issued to Kabele on Aug. 29, 1978.

U.S. Pat. No. 3,140,755 issued to Tranel on July 14, 1964, and shows a muffler formed from four plates, with a stop-weld material applied to selected surface regions of the plates. The plates are then welded in face-to,-face relationship, and fluid pressure is applied to portions of the plates having the stop-weld thereon. The fluid pressure effectively balloons-out these unwelded portions of the plates. The innermost plates of U.S. Pat. No. 3,140,755 have stop-well selectively located to define a tube that extends through a 180° change in direction and terminates at a location spaced from the periphery of the muffler. The outer plates define a single large chamber surrounding the tube. The end of the chamber opposite the inlet to the muffler is formed to define an outlet. One muffler shown in U.S. Pat. No. 3,140,755 includes a plurality of quarter wave tuning tubes extending orthogonally from the flow tube through the muffler. These quarter wave tuning tubes do not communicate directly with the chamber of the muffler. Another muffler depicted in U.S. Pat. No. 3,140,755 disposes the stop-weld to cause portions of the external shell to be welded to the tube for reinforcement of the external shell. This attachment does not divide the muffler into separate chambers. The single chamber of all mufflers shown in U.S. Pat. No. 3,140,755 would be very limited functionally.

Recently there have been several very significant advances in stamp formed muffler technology disclosed in patents assigned to the assignee of the subject invention. For example, U.S. Pat. No. 4,700,806 issued to Jon Harwood on Oct. 20, 1987 and shows a muffler formed from stamped components and providing the combination of at least one tuning tube and at least one low frequency resonating chamber. The length of the tuning tube extends along the abutting surfaces of the plates from which the tubes are formed. Mufflers manufactured in accordance with U.S. Pat. No. 4,700,806 have proved to be successful in attenuating broad frequency ranges of exhaust gas noise, and have achieved significant commercial success in a relatively short term on the market. U.S. Pat. No. 4,736,817 issued to Jon Harwood on Apr. 12, 1988 as a continuation of the above referenced U.S. Pat. No. 4,700,806. U.S. Pat. No. 4,736,817 shows and claims a muffler having an external shell with a crease formed therein to define a baffle between adjacent chambers of the muffler.

U.S. Pat. No. 4,765,437 issued to Harwood et al. on Aug. 23, 1988 and shows a stamp formed muffler having a pair of formed internal plates defining an array of tubes and a pair of external shells. The muffler shown in U.S. Pat. No. 4,765,437 includes an expansion chamber and a pair of low frequency resonating chambers. The muffler is provided with only one baffle crease formed in each of the external shells. This efficient design facilitates the stamping of the external shell and saves metal as compared to shells having plrral baffle creases.

U.S. Pat. No. 4,821,840 issued to the inventors herein on Apr. 18, 1989 and shows a stamp formed muffler with a conformal outer shell configured to enable the muffler to conform to the shape of the available space on the vehicle.

U.S. Pat. No. 4,860,853 issued to Moring on Aug. 29, 1989 and shows a stamp formed muffler with a non-planar array of tubes. The disclosure of U.S. Pat. No. 4,860,853 explains the several structural and functional advantages afforded by the disclosed design, including a highly reinforced outer shell which eliminates shell ring. Additionally, certain of the embodiments depicted and described in U.S. Pat. No. 4,860,853 provide an extremely efficient muffler with only three stamp formed plates.

Many of the mufflers shown in the above identified patents that are assigned to the assignee of the subject invention are made from a pair of plates that are stamped to define an array of tubes therebetween and at least one external shell having a crease which extends into contact with one of the plates to define a baffle between two chambers of the muffler. The baffle crease in these patents is depicted as extending generally transverse to the direction of the tubes. Thus, the baffle crease includes a nonlinear base with semicircular portions that conform to the cross-sectional shape of the tubes stamp formed in the plates. Additionally, the baffle crease must extend to a depth defined by portions of the adjacent plate intermediate the tubes formed therein. This can require very complex stamp formed configurations for the external shell with considerable drawing and stretching of the metal of the shell. Deep draws of metal as part of stamp forming processes necessarily requires a greater amount of metal with correspondingly high raw material costs and a heavier finished product.

It has been suggested that prior art stamped muffler having a plurality of tubes extending across a baffle crease will necessarily create pockets that can trap moisture or corrosive liquids and lead to a premature failure of the muffler. This alleged potential for corrosion of stamp formed mufflers in the vicinity of pockets defined in the baffle creases has not been observed in tests performed to date. However, a muffler that clearly avoids any such potential for corrosion in the area of the baffle crease is shown in U.S. Pat. No. 4,836,330 which issued to Harwood et al. on June 6, 1989. More particularly, the muffler shown in U.S. Pat. No. 4,836,330 includes only a single tube extending across the baffle crease to avoid the creation of any pockets for trapping moisture in the baffle crease. Although the mufflers shown in U.S. Pat. No. 4,836,330 clearly avoid the potential problem for corrosion in the area of the baffle crease, they still require considerable drawing of metal material.

Another attempt to address the potential problem of corrosion in the vicinity of pockets in the baffle crease of a stamped muffler is shown in U.S. Pat. No. 4,865,154 which issued to Hanson et al. on Sept. 12, 1989. Rather than attempting to avoid the creation of pockets, Hanson provides small drain holes in the areas of the pockets in an effort to permit drainage of any fluids that may accumulate therein. It is believed that any fluids that may accumulate in the pockets of the baffle crease would generally be in the nature of a thick sludge that would quickly clog the drain hole shown in U.S. Pat. No. 4,865,154. Thus, the teaching of U.S. Pat. No. 4,865,154 would appear, at least, to provide only a temporary solution for the alleged problem of corrosion in the vicinity of a baffle crease of a muffler. Furthermore, U.S. Pat. No. 4,865,154 is not effective in reducing the amount of draw of metal in the vicinity of the baffle crease. In fact, several embodiments depicted in U.S. Pat. No. 4,865,154 require even a greater drawing of metal material by providing a flange in one external shell which extends through the aperture defined at the deepest part of the baffle crease.

In view of the above, it is an object of the subject invention to provide a stamp formed muffler which reduces the amount of metal material required to form the external shell of the muffler.

It is another object of the subject invention to provide a stamp formed muffler that provides substantially simpler metal formation in the vicinity of the baffle crease defined in the external shell of the muffler.

It is a further object of the subject invention to provide a stamp formed muffler having a shallower draw of metal for defining the baffle between chambers of the muffler.

It is still an additional object of the subject invention to provide a stamp formed muffler that avoids the creation of pockets in the external shell of the muffler.

SUMMARY OF THE INVENTION

The subject invention is directed to a muffler comprising a plurality of formed components. In particular, the muffler comprises a pair of plates and at least one external shell. The plates are disposed in face to face relationship with one another, and at least one of the plates is formed to define an array of tubes between the plates. More particularly, at least one of the plates is formed to define an array of channels extending away from the abutting surfaces of the plates, such that the channels in one plate and the opposed portion of the other plate define the array of tubes. In the typical embodiment each plate will be formed with an array of channels, with the respective arrays of channels being disposed generally in register with one another and with the tubes being defined by opposed channels.

Selected portions of the tubes are provided with communication means formed therethrough for permitting a controlled communication of exhaust gases from the tubes into a chamber defined by the external shell, as explained herein. The communication means formed in the tubes may be defined by an array of formed perforations, or other apertures which permit a communication of exhaust gases from the tubes. The cross-sectional dimensions and the alignment of the respective tubes will be selected in accordance with the flow characteristics of the exhaust gases and the noise attenuation requirements. Selected tubes in the array may define tuning tube's which communicate with low frequency resonating chambers as explained further herein.

The external shell is secured to at least one of the formed plates. The external shell is formed to define a plurality of chambers surrounding selected portions of the tubes defined by the plates. More particularly, the external shell may be formed to include a peripheral flange and a plurality of chambers extending from the peripheral flange. At least one baffle crease is defined in the external shell to separate the chambers from one another.

The baffle crease defined in the external shell and at least one of the tubes defined by the internal plates are disposed to be substantially in register with one another. More particularly, at least one of the tubes defined by the internal plates includes a longitudinal axis extending parallel to the baffle crease of the external shell. The baffle crease may define a depth to achieve abutting contact between the baffle crease and the tube extending parallel thereto. Thus, the baffle which separates one chamber from the other is defined by the baffle crease and a portion of the tube extending parallel to the baffle crease. This is in contrast to prior art stamp formed mufflers disclosed in the above referenced prior art where the tubes intersected the baffle crease at a deep complex stamp formed draw which defined potentially objectionable pockets in the exterior of the muffler. The parallel and registered alignment of the baffle crease and the tube in the muffler of the subject invention results in a substantially shallower draw which is easier to form and utilizes less metal. The baffle crease is of uniform shallow depth along its entire length and therefore does not include pockets. As a result, the muffler of the subject invention uses less metal than the above described prior art designs, reduces the probability of ruptured metal during stamping operations and completely avoids pockets which some have asserted could lead to corrosion of metal in the pocket areas.

The muffler of the subject invention may include a pair of external shells mounted respectively to the opposed plates. Each external shell may include a baffle crease disposed and dimensioned to engage a tube running parallel therewith.

DETAILED DESCRIPTION OF THE PREFERRED EMBODIMENTS

Figure 1:
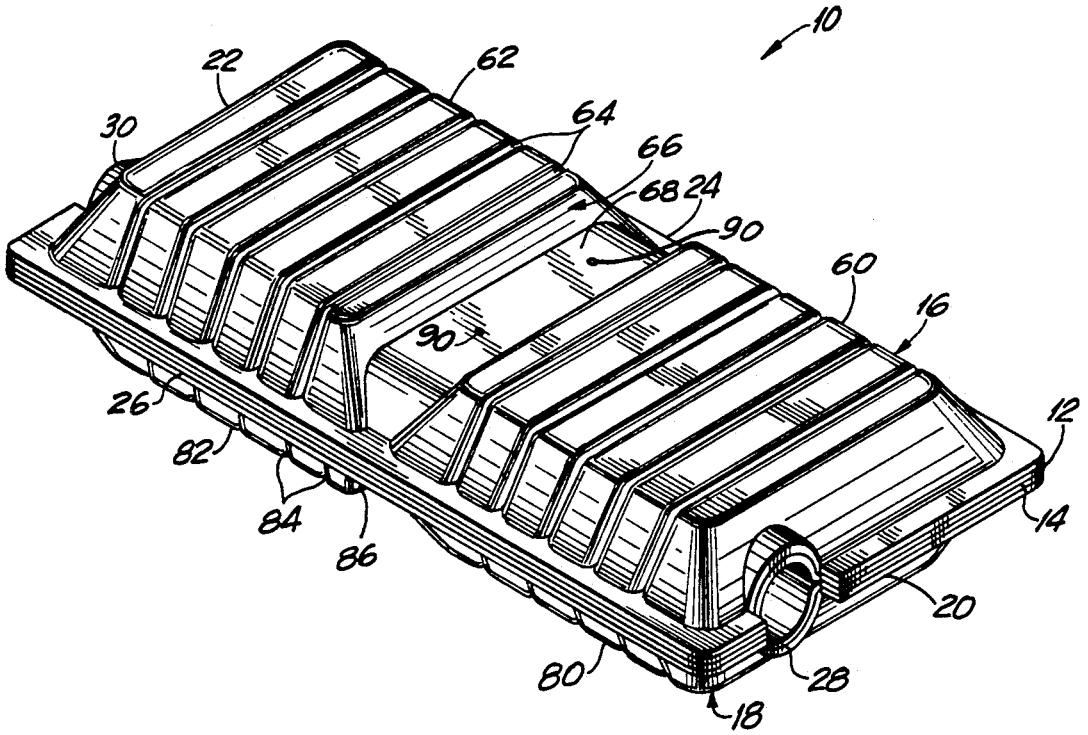
FIG. 1 is a perspective view of a muffler in accordance with the subject invention.

The muffler of the subject invention is identified generally by the numeral 10 in FIGS. 1 ∝ 7. The muffler 10 comprises first and second plates 12 and 14 secured in abutting face-to-face relationship with one another and first and second external shells 16 and 18 securely disposed around and substantially enclosing the plates 12 and 14. The muffler 10 is of generally rectangular configuration and includes opposed longitudinal ends 20 and 22 and opposed sides 24 and 26 extending generally parallel to one another between the opposed ends 20 and 22. It is to be understood, however, that many other configurations of the muffler may be provided in accordance with the available space on the vehicle. In this regard reference is directed to U.S. Pat. No. 4,821,840 which issued to the inventors herein and shows conformal mufflers which effectively nest into the available space on a vehicle.

The muffler 10 includes an inlet 28 and an outlet 30 disposed respectively at the opposed first and second opposed ends 20 and 22 of the muffler 10. The inlet 28 and outlet 30 are connectable to an exhaust pipe and tail pipe of a vehicle. The muffler 10 alternatively could be provided with the inlet and outlet at other locations, and alternatively could be provided with more than one inlet and/or more than one outlet. In this regard, attention is directed to U.S. Pat. No. 4,760,894.

Figure 4:
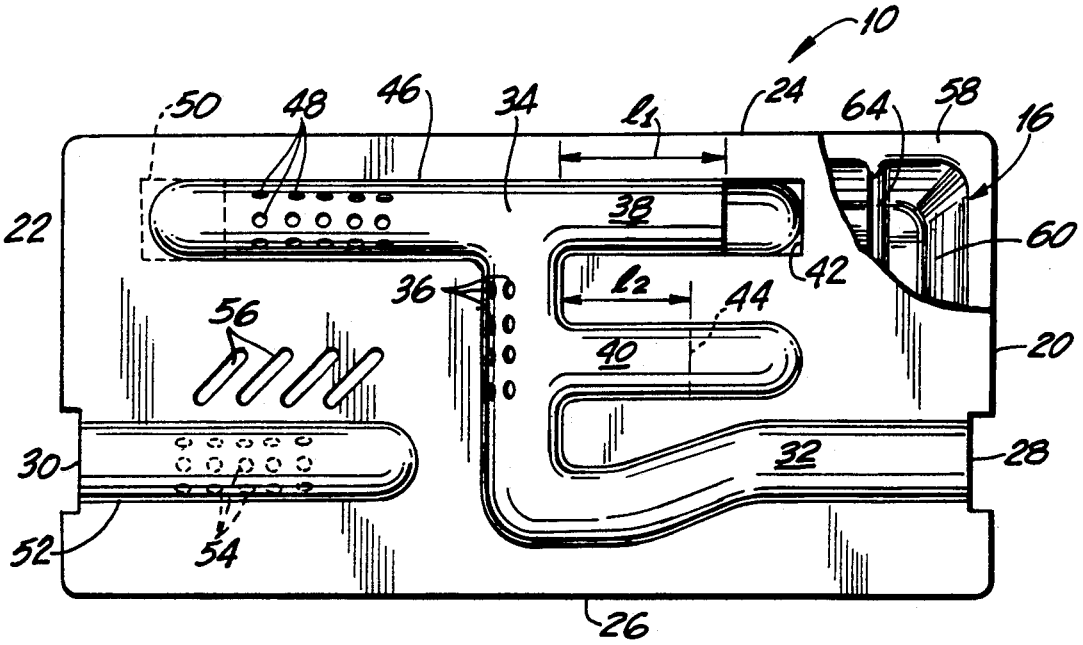
FIG. 4 is a top plan view similar to FIG. 3 but showing the top external shell partly in section.

As noted above, FIG. 4 effectively shows a top plan view of the muffler 10 with the external shell 16 in section. The internal plate 12, as shown in FIG. 4 is stamp formed to define an array of channels therein. A corresponding and registered array of channels is included in the plate 14. It is to be understood, however, that perfect registration of the channels in the plates 12 and 14 is not required.

The plates 12 and 14 are stamped to include an inlet tube 32 which extends in a generally longitudinal direction from the first end 20 of the muffler toward the second end 22 thereof. The inlet tube 32 communicates with a transverse baffle tube 34 which communicates with the inlet tube 32 substantially at right angles. The transverse baffle tube 34 also is generally perpendicular to the opposed sides 24 and 26 of the muffler 10. An array of perforations 36 is formed in the side <of the transverse baffle tub 34 generally facing the second end 22 of the muffler 10. In many embodiments, the perforations 36 will not be required and therefore will not be present in the transverse baffle tube 34.

The transverse baffle tube 34 communicates with first and second tuning tubes 38 and 40 respectively. The first tuning tube 38 communicates with a low frequency resonating chamber formed in the first external shell 16 through aperture 42 in the first plate 12. The length "$1_1$" of the first tuning tube 38, the cross-sectional dimensions thereof and the volume defined by the low frequency resonating chamber formed in the first plate 12 all are selected in accordance with the particular narrow range of low frequency noise to be attenuated. It will be noted that the portion of the second plate 14 defining the first tuning tube 38 does not terminate in a tuning aperture. Consequently, the first tuning tube 38 does not communicate with any chamber defined by the second plate 14.

On the other hand, the second tuning tube 40 is defined by opposed channels in the first and second plates 12 and 14. The channel in the first plate 12 defining the second tuning tube 40 is substantially free of apertures at the end thereof. However, the channel in the second plate 14 defining a portion of the second tuning tube 40 includes a tuning aperture 44 which defines the effective length $l_2$ of the second tuning tube 40. Thus, the second tuning tube 40 will communicate with a low frequency resonating chamber defined by the second external shell 18.

The first and second plates 12 and 14 are further stamped to define an expansion tube 46 extending longitudinally generally orthogonally from the end of the transverse baffle tube 34 opposite the inlet tube 32. The portion of than expansion tube 46 defined by the first plate 12 is characterized by an array of perforations 48 stamped therein. However, the portion of the expansion tube 46 defined by the second plate 14 is not provided with perforations in the embodiment of the muffler 10 depicted herein. Consequently, exhaust gases will flow through the perforations 48 in the first plate 12 and into a chamber of the muffler defined by the first external shell 16, as explained further below. It should be noted that the perforations 48 are depicted as being substantially round. However, other means could be provided for communication of exhaust gases from the expansion tube 46. For example, louvers or a large aperture 50 as depicted by the broken lines in FIG. 4 could be provided as substantially equivalent communication means.

The first and second plates 12 and 14 further are stamped to define an outlet tube 52. The portion of the outlet tube 52 defined by the first plate 12 is substantially free of perforations or other such communication means. However, the portion of the outlet tube 52 defined by the second plate 14 includes perforations 54 therein. Communication between the expansion tube 46 and the outlet tube 52 is provided by a plurality of slots 56 stamp formed through the plates 12 and 14 at locations thereon intermediate the expansion tube 46 and the outlet tube 52. As a result, exhaust gases entering the expansion tube 46 will flow through the perforations 48 and into the expansion chamber defined by the first external shell 16. These exhaust gases will then flow through the slots 56 in both plates 12 and 14 and into the opposed expansion chamber defined by the second external shell 18 and from there through the aperture 54 in the second plate 14 and into the outlet tube 52.

Many other flow patterns and gas communication means can be provided for permitting a flow of exhaust gas from the transverse baffle tube 34 to the outlet tube 52. For example, a single large opening may be provided through the plates intermediate the expansion tube 46 and the outlet tube 52 in place of the slots 56 depicted in FIG. 4. Alternatively, a single circuitous tube having a selected array of perforation means may extend from the transverse baffle tube 34 to the outlet tube 52. The particular pattern of tubes and exhaust gas communication means will be dependent upon the particle exhaust system design parameters.

Figure 2:
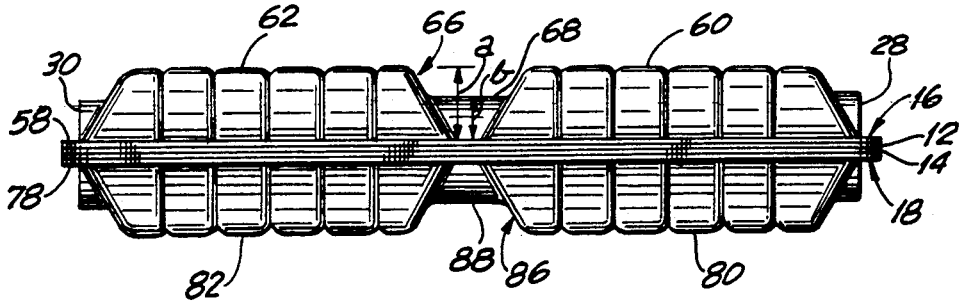
FIG. 2 is a side elevational view of the muffler shown in FIG. 1.
Figure 3:
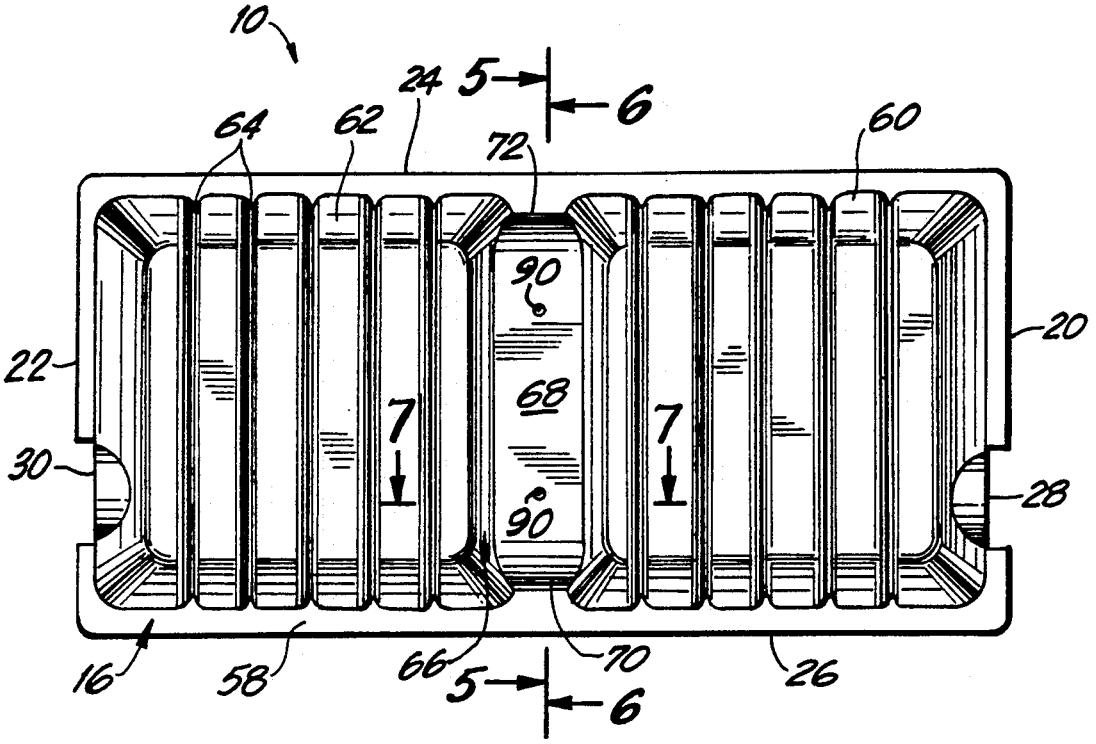
FIG. 3 is a top plan view of the muffler shown in FIG. 1.
Figure 5:
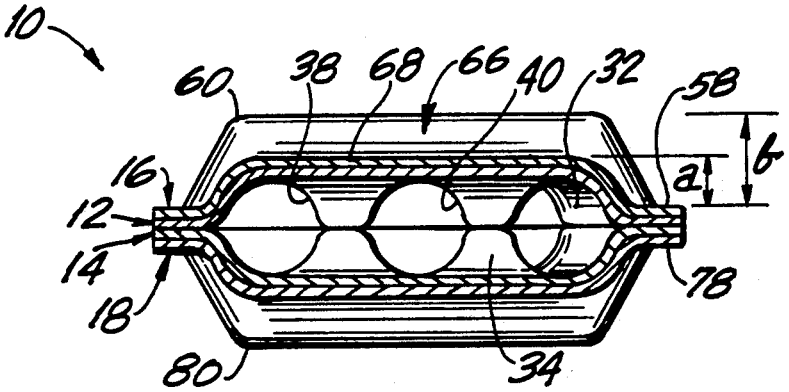
FIG. 5 is a cross-sectional view taken along line 5—5 in FIG. 3.
Figure 6:
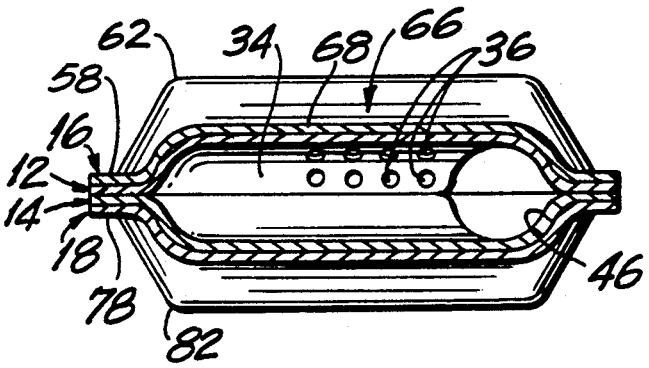
FIG. 6 is a cross-sectional view taken along line 6—6 in FIG. 3.
Figure 7:
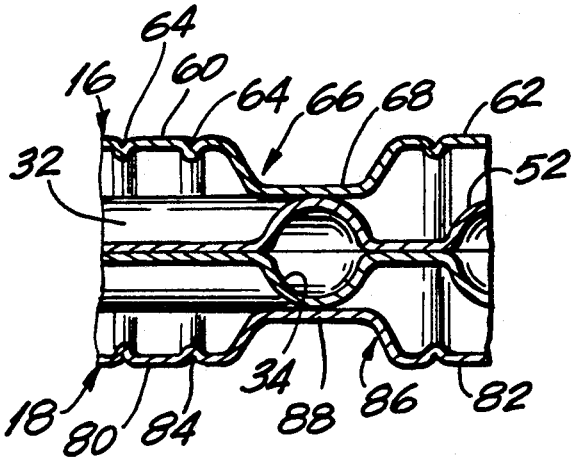
FIG. 7 is a cross-sectional view taken along line 7—7 in FIG. 3.

The first external shell 16 includes a planar peripheral flange 58 which is dimensioned to be placed substantially in register with peripheral portions of the first plate 12. The external shell 16 further includes a low frequency resonating chamber 60 and an expansion chamber 62 which extend upwardly and away from the plane defined by the peripheral flange 58. The low frequency resonating chamber 60 and the expansion chamber 62 both are characterized by reinforcing ribs which preferably are configured as described in copending application Ser. No. 227,807 to prevent excessive vibrations of the external shells and vibration related noise or shell ring. The low frequency resonating chamber 60 formed in the first external shell 16 is disposed to surround the tuning aperture 42 stamped in the first plate 12 at the end of the first tubing tube 38 thereof. The expansion chamber 62 formed in the first external shell 16 is disposed to substantially surround &he perforations 36 and 48 stamped in the first plate 12. The low frequency resonating chamber 60 and the expansion chamber 62 are separated from one another by a baffle crease 66. The baffle crease 66 is disposed to be substantially parallel to and in register with the transverse baffle tube 34. More particularly, as shown most clearly in FIGS. 5–7, the baffle crease 66 in the first external shell 16 extends continuously between spaced apart locations on the peripheral flange 58 a depth sufficient to engage the portion of the transverse baffle tube 34 defined by the first plate 12. As shown in FIGS. 5 and 6, a central portion 68 of the baffle crease 66 is substantially a constant distance "a" from the plane of the peripheral flange 58, and is substantially free of pockets or depressions that conceivably could accumulate fluids or corrosive materials. Additionally, the convexly arcuate portions 70 and 72 of the central portions 68 adjacent the peripheral flange 58 facilitates the runoff of any liquid that may temporarily land on the central portion 68. As shown most clearly in FIG. 2, distance "a" by which the central portion base 68 of the baffle crease 66 is offset from the peripheral flange 58 is approximately one-half the maximum draw "b" required to form the chambers 60 and 62 in the first external shell 16. Thus, deep draws of metal material intermediate the chambers 60 and 62 are not required with a corresponding savings in metal and a reduced possibility for rupturing metal during stamp forming processes. Other ratios of dimensions "a" and "b" may be provided in accordance with specific design and acoustic requirements.

In the embodiment depicted herein the second external shell 18 is substantially a mirror image of the first external shell 16. More particularly, the second external shell 18 is stamped to include a peripheral flange 78 dimensioned and configured to be placed substantially in register with peripheral portions of the second plate 14. The second external shell 18 further is stamped to define a low frequency resonating chamber 80 and an expansion chamber 82, each of which includes an array of reinforcing ribs 84 therein. The low frequency resonating chamber 80 is disposed to surround the tuning aperture 44 in the portion of the second plate 14 defining the second tuning tube 40 of the muffler 10. The length and cross-sectional dimensions of the second tuning tube 40 and the volume of the low frequency resonating chamber 80 are selected in accordance with the frequency of sound to be attenuated. The expansion chamber 82 surrounds the perforations 54 in the second plate 14 and the slots 56 extending through both the first and second plates 12 and 14. Thus, the expansion chamber 82 will enable a cross-flow of exhaust gas from the expansion tube 46 to the outlet tube 52 of the muffler 10.

The low frequency resonating chamber 80 and the expansion chamber 82 are separated from one another by a baffle crease 86 which extends continuously between spaced apart locations on the peripheral flange 78 and is disposed to be in register with the transverse baffle tube 34. More particularly, the depth of the baffle crease 86 is selected to ensure abutting face-to-face contact between a central portion 88 of the baffle crease 86 and the portion of the transverse baffle tube 34 defined by the second plate 14. Thus, the baffle crease 86 and the portion of the transverse baffle tube 34 defined by the second plate 14 will isolate the low frequency resonating chamber 80 from the expansion chambers 82 and 62 which communicate with one another.

As shown herein, the second external shell 18 defines the bottom portion of the muffler 10. Consequently, the presence of pockets in a baffle crease would not be a problem in terms of an accumulation of fluid and potential corrosive action on the muffler from such fluid. However, the cooperation between the baffle crease 86 and the portion of the transverse baffle tube 34 defined by the second plate 14 achieves the above described advantages of a shallow stamped draw, a reduced possibility for metal failure during stamping and a savings of metal material.

The muffler 10 may be manufactured by stamping the first and second plates 12 and 14 and the first and second external shells 16 and 18 in accordance with the apparatus and method disclosed in U.S. Pat. No. 4,847,965 and co-pending application Ser. No. 325,650. The stamped plates 12 and 14 are then fixtured in opposed relationship to one another and preferably are securely connected to one another at a plurality of locations thereon. This initial interconnection of the plates 12 and 14 may be carried out by spot welding or other metal fusing or mechanical fixation means. The first and second external shells 16 and 18 may then be fixtured around the initially interconnected plates 12 and 14. This interconnected assembly may be initially tack-welded or spot-welded to one another at a plurality of discrete locations, including at least one location 90 in the baffle crease 66, and a corresponding location in the baffle crease 86. This welding in the baffle creases 66 and 86 prevents vibration between abutting surfaces of the plates 12 and 14 and the external shells 16 and 18 and further contributes to the strength of the muffler. The muffler 10 is then presented to means for securely and permanently connecting the peripheral portions of the plates 12 and 14 and external shells 16 and 18. The details of the assembly process summarized herein are disclosed in greater detail in co-pending application Ser. No. 335,120. The resulting muffler achieves all of the substantial structural and manufacturing efficiencies described above and in the related patents and applications. In addition to those advantages, the muffler 10 completely avoids the pockets in the baffle crease which was previously identified as being a possible source for accumulation of corrosive materials. Furthermore, the baffle creases 66 and 86 enable a much easier draw of metal with a significant savings of metal material and a lower probability of metal failure during stamping.

In summary, a muffler is provided with a pair of plates and at least one external shell. The plates are formed to define an array of tubes therebetween. The external shell is formed to define a plurality of chambers separated from one another by a baffle crease. At least one of the tubes defined by the plates of the muffler is a transverse baffle tube disposed to be substantially in register with the baffle crease. The depth of the baffle crease is selected to achieve face-to-face contact between the base of the baffle crease and the tube in register therewith. Thus, the combination of the tube defined by the plates of the muffler and the baffle crease defined by the external shell of the muffler separate adjacent chambers from one another. The baffle crease may be spot welded or plunge welded to the tube in register therewith to prevent vibration between abutting surfaces of the external shell and plate and to entrance the strength of the muffler.

While the invention has been described with respect to a preferred embodiment, it is apparent that various changes can be made without departing from the scope of the invention as defined by the appended claims. For example, the muffler may be provided with a pair of plates and only one external shell. Alternatively, the muffler may be provided with a plurality of baffle creases in each external shell and a corresponding plurality of transversely aligned tubes in register with the baffle creases. The internal configuration of the muffler may be substantially different from that depicted herein, and is selected in accordance with the gas flow characteristics and noise attenuation requirements for the muffler. The muffler also may be of any specified shape and may be provided with reinforcing ribs substantially different from those depicted herein.

We claim:

1. A stamp formed muffler comprising:

first and second plates secured in face-to-face relationship, said plates being stamp formed to define an array of tubes therebetween, said tubes comprising an inlet to the muffler and an outlet from the muffler, selected portions of said tube intermediate said inlet and said outlet including communication means formed through at least one of said plates for permitting communication of exhaust gases from said tubes; and an external shell formed to define a plurality of chambers therein, an elongated baffle crease being formed in said external shell intermediate the chambers thereof, said external shell being securely connected to one of said plates such that the chambers surround selected communication means in said plate, said baffle crease extending substantially parallel to a selected one of said tubes and being disposed in direct abutting contact with said selected tube such that the baffle crease and the tube in contact therewith define a baffle for separating the chambers of the muffler.

2. A muffler as in claim 1 wherein the external shell includes a generally planar peripheral flange, said baffle crease being spaced from the plane defined by the peripheral flange.

3. A muffler as in claim 1 wherein the baffle crease is substantially free of depressions at all locations along a length thereof.

4. A muffler as in claim 1 wherein the external shell includes a periphery, said baffle crease connecting spaced apart locations on the periphery of the external shell, said baffle crease being of generally convex configuration intermediate the spaced apart locations on the periphery of the muffler to facilitate drainage of liquid from external locations on the muffler.

5. A muffler as in claim 1 wherein the external shell includes a periphery extending thereabout said baffle crease connecting spaced apart locations cn the periphery of the external shell, said baffle crease being generally convex at locations thereon adjacent the periphery of the external shell and being substantially planar intermediate said convex portions.

6. A muffler as in claim 1 wherein the array of tubes comprises an inlet tube and an outlet tube in communication respectively with the inlet and outlet of the muffler, said inlet and outlet tube being generally parallel to one another, said array of tubes further comprising a transverse baffle tube having a length aligned generally orthogonal to the inlet and outlet tubes, said transverse baffle tube being in contact with the baffle crease along at least major portion of the length thereof.

7. A muffler as in claim 1 wherein the baffle crease is securely connected to the tube of the muffler in abutment therewith.

8. A muffler as in claim 1 wherein the plates each are formed to define an array of channels, with the channels of one plate being substantially in register with the channels of the other plate to define the array of tubes between said plates, and wherein the muffler further comprises a second external shell formed to define a plurality of chambers with a baffle crease disposed between the chambers of the second plate, the baffle crease of the second plate being disposed in abutting face-to-face contact with a selected channel in the second plate, such that the baffle crease of the second external shell and the abutting channel of the second plate define a baffle for separating the chambers defined by said second external shell.

9. A stamp formed muffler comprising:

first and second plates secured in face-to-face relationship, said plates being stamp formed to define an array of tubes therebetween, said tubes comprising an inlet tube, an outlet tube, and a baffle tube, selected tubes in said array comprising communication means formed therethrough for permitting communication of exhaust gases from said tubes; and an external shell having a peripheral portion secured to the first plate and a plurality of chambers formed in said external shell and extending from the peripheral portion, such that each said chamber of said external shell surround selected portions of said communication means in said tubes, said external shell further including an elongated baffle crease intermediate said chambers, said baffle crease being aligned parallel to the baffle tube and being in abutting face-to-face relationship with said baffle tube such that said baffle crease and said baffle tube substantially separate the chambers of said external shell from one another.

10. A muffler as in claim 9 wherein the baffle crease comprises convex portion extending from the peripheral portions of said external shell and a central portion extending continuously between the convex portions.

11. A muffler as in claim 10 wherein the complex portion of the baffle crease is securely connected to the baffle tube of the muffler.

12. A muffler as in claim 10 wherein the peripheral portion of the external shell lie substantially in a common plane, and wherein the central portion of the baffle crease extends substantially parallel to the plane of the peripheral portion of the external shell.

13. A muffler as in claim 12 wherein the peripheral portion of said external shell define a peripheral flange.

14. A muffler as in claim 9 wherein the baffle crease is substantially free of indentations at all locations thereon along a length thereof.

15. A muffler as in claim 9 wherein the baffle tube is aligned substantially orthogonally to the inlet and outlet tubes.

16. A muffler as in claim 9 wherein a portion of said communication means are formed in the baffle tube.

17. A muffler as in claim 9 wherein said baffle tube intersects a selected one of said inlet and outlet tubes.

* * * * *